US006885139B2

(12) United States Patent
Jeong et al.

(10) Patent No.: US 6,885,139 B2
(45) Date of Patent: Apr. 26, 2005

(54) COLOR SELECTION APPARATUS FOR COLOR CATHODE RAY TUBE

(75) Inventors: Jae-Ho Jeong, Busan (KR); Myung-Sup Seo, Busan (KR); Sang-Shin Choi, Suwon (KR); Jae-Woo Kim, Busan (KR)

(73) Assignee: Samsung SDI Co., Ltd., Suwon (KR)

( * ) Notice: Subject to any disclaimer, the term of this patent is extended or adjusted under 35 U.S.C. 154(b) by 21 days.

(21) Appl. No.: 10/187,724

(22) Filed: Jul. 1, 2002

(65) Prior Publication Data

US 2003/0001482 A1 Jan. 2, 2003

(30) Foreign Application Priority Data

Jul. 2, 2001 (KR) ..... 2001-39303

(51) Int. Cl.[7] ..... H01J 29/80
(52) U.S. Cl. ..... 313/404; 313/407
(58) Field of Search ..... 313/402, 405, 313/407, 408

(56) References Cited

U.S. PATENT DOCUMENTS

| | | | | | |
|---|---|---|---|---|---|
| 3,700,948 | A | * | 10/1972 | Palac | 313/405 |
| 3,823,336 | A | * | 7/1974 | Nakamura et al. | 313/405 |
| 4,300,071 | A | * | 11/1981 | Dougherty et al. | 313/407 |
| 4,779,023 | A | * | 10/1988 | Strauss | 313/402 |
| 4,780,641 | A | * | 10/1988 | Hashiba et al. | 313/269 |
| 5,284,289 | A | * | 2/1994 | Killian | 228/165 |
| 5,394,051 | A | * | 2/1995 | Lerner | 313/403 |
| 5,982,084 | A | * | 11/1999 | Etou | 313/406 |
| 6,271,624 | B1 | * | 8/2001 | Taguchi et al. | 313/402 |
| 6,339,283 | B1 | * | 1/2002 | Horiuchi | 313/407 |
| 6,566,799 | B1 | * | 5/2003 | Ragland, Jr. | 313/407 |
| 6,580,204 | B1 | * | 6/2003 | Kim et al. | 313/404 |

FOREIGN PATENT DOCUMENTS

| | | | |
|---|---|---|---|
| EP | 000500312 A1 | * | 8/1992 |
| JP | 7-29500 | * | 5/1993 |
| JP | 07-230760 | | 8/1995 |
| JP | 11-329272 | * | 10/1998 |

* cited by examiner

*Primary Examiner*—Nimeshkumar D. Patel
*Assistant Examiner*—German Colón
(74) *Attorney, Agent, or Firm*—Christie, Parker and Hale, LLP

(57) ABSTRACT

A color selection apparatus for a cathode ray tube. A mask frame having a pair of supporting members is disposed in parallel and spaced away from each other. A pair of elastic members is disposed between and coupled to the supporting members. A tensioned mask is coupled to the supporting members and is provided with a plurality of beam-passing apertures. A spring assembly includes a hook having a frame fixing part fixed on the mask frame and a spring fixing part and a spring fixed to the spring fixing part. The hook has a cut-away portion defined by cutting a portion of the frame fixing part. The cut-away portion forms a welding portion for welding the hook to the mask frame.

12 Claims, 3 Drawing Sheets

COLOR SELECTION APPARATUS FOR COLOR CATHODE RAY TUBE

CROSS-REFERENCE TO RELATED APPLICATIONS

This application claims the benefit of Korean Application No. 2001-39303, filed on Jul. 2, 2001 in the Korean Patent Office, the entire disclosure of which is incorporated herein by reference.

FIELD OF THE INVENTION

The present invention relates to a color selection apparatus for a color cathode ray tube (CRT), and more particularly, to a color selection apparatus for a CRT with a tension mask.

BACKGROUND OF THE INVENTION

Generally, a CRT is designed to realize an image by electron-beams emitted from an electron gun and scanning a phosphor screen deposited with red R, green G and blue B phosphors. The CRT typically includes a panel with a phosphor screen at its inner surface, an electron gun for emitting electron beams, a neck portion for receiving the electron gun, a funnel for connecting the panel to the neck portion, and a color selection apparatus mounted on an inner surface of the panel.

The color selection apparatus is disposed facing the phosphor screen to let the electron beams emitted from the electron gun land on the corresponding phosphors. The color selection apparatus includes a shadow mask functioning as an electrode, a mask frame for supporting the shadow mask, and a spring assembly for fixing the mask frame on the panel.

The shadow mask is formed by drawing AK steel or INVAR steel after a plurality of beam-passing apertures are formed on the steel through a photolithography process. Since the shadow mask is very thin when compared with its large area and hundreds of thousands of apertures are formed on such a thin plate, its strength is very low. Therefore, the shadow mask may be easily depressed by outer shock or domed toward the phosphor screen by the thermal expansion caused by electron beams emitted from the electron gun.

When the shadow mask is depressed or domed, the location of the beam-passing apertures is shifted. This may deteriorate the color purity as the shadow mask cannot precisely select the color.

To develop a shadow mask suitable for the trend toward the large-sized and flattened CRT while solving the above described problems, Japanese laid-open patent No. H7-230760 discloses a tensioned mask that is fixed on the frame in a state where tension is applied thereto.

That is, as shown in FIG. 4, tensioned mask 104 provided with a plurality of beam-passing apertures 102 is tensioned in a vertical direction (in a direction of a Y-axis in the drawing) and welded on supporting members 106 that are connected to each other by a pair of elastic members 108.

Supporting members 106 and elastic members 108 define mask frame 110 supporting tensioned mask 104.

Spring assembly 112 for mounting mask frame 110 on an inner surface of the panel is mounted on each sidewall of supporting members 106 and elastic members 108.

Spring assembly 112 includes hook 114 having one end welded on supporting member 106 or elastic member 108 and spring 116 having a first end fixed on hook 114 and a second end coupled on a stud pin (not shown) buried on an inner surface of the panel through coupling hole 116*a*. Hook 114 includes a high thermal expansion member and a low thermal expansion member that are joined to each other lengthwise.

Tensioned mask 104 and mask frame 110 that are integrally welded goes to a heat-treatment process including a darkening process. The darkening process is for forming a dark layer on tensioned mask 104 by injecting a mixture gas of air and propane into a darkening furnace having a temperature of about 610~620° C.

However, when mask frame 110 is subjected to a variable heat-treatment process and the process varies less than desired, tensioned mask 104 may undergo elastic deformation due to the loss of its tensile force. The CRT's display quality can then become deteriorated.

To solve this problem, reinforcing member 118 having a thermal expansion coefficient higher than elastic members 108 is welded on a lower portion of elastic members 108. Alternatively, a reinforcing member having a thermal expansion coefficient lower than elastic members 108 is welded on an upper portion of elastic members 108. Reinforcing member 118 is deformed during the heat-treatment process so that tensioned mask 104 is applied with a retraction force in a the curved arrow directions of FIG. 4, thereby suppressing the elastic deformation of tensioned mask 104.

In addition, reinforcing member 118, hook 114, and tensioned mask 104 sequentially go through the welding process in this order by a resistance welding at two or three welding points 120.

Here, the resistance welding is performed by applying a current of 6,000~7,000 amperes in a short time in a state where members to be welded to each other are overlapped and applied with a predetermined pressure, thereby welding the members to each other by melting the members using a heat resistance generated by a contact resistance between the members.

However, when welding the reinforcing member and the hook to the mask frame, the welding does not occur simultaneously but occurs in a predetermined time sequence.

Accordingly, due to the high heat generated during the welding of the first welding point, the members (reinforcing member, mask frame and etc.) to be welded increase in temperature. As a result, the contact area of the welding electrode is enlarged during the welding of the second and third welding points, thereby forming oxide layer which deteriorates the electric conduction.

Therefore, the welding force at the second and third welding points is lower than that at the first welding point, deteriorating the welding reliability. When a sample frame is used for checking the welding force to improve the welding reliability, the costs are increased.

Furthermore, since the high current of 6,000~7,000 amperes is used for the resistance welding, the mask frame is magnetized at a magnetic flux density of about 60~70 gausses after the welding process is finished.

Accordingly, a degaussing process for reducing the magnetic flux density inevitably needs to be performed for the magnetized mask frame.

Therefore, the present invention has been made in an effort to solve the above-described problems.

SUMMARY OF THE INVENTION

In accordance with the present invention a color selection apparatus is provided that is reduced in its magnetic flux density, and avoids the need for performing a sampling test, thereby allowing naked eye inspection.

A color selection apparatus for a cathode ray tube is provided. A mask frame having a pair of supporting members is disposed in parallel and spaced away from each other. A pair of elastic members is disposed between and coupled to the supporting members. A tensioned mask is coupled to the supporting members and is provided with a plurality of beam-passing apertures. A spring assembly includes a hook having a frame fixing part fixed on the mask frame and a spring fixing part and a spring fixed to the spring fixing part, wherein the hook having a cut-away portion is defined by cutting a portion of the frame fixing part, the cut-away portion forming a welding portion for welding the hook to the mask frame.

The cut-away portion may be formed by cutting a middle portion of one end of the frame fixing part. The welding portion is formed in the vicinity of a surface of the cut-away portion in parallel with the one end of the frame fixing part.

Alternatively, the cut-away portion may be formed by cutting both sides of one end of the frame fixing part. The welding portion is formed in the vicinity of a surface of the cut-way portion in parallel with the one end of the frame fixing part.

Alternatively, the cut-away portion may be formed by forming plural apertures on the frame fixing part. The apertures are formed in a circular-shape.

The hook and the mask frame may be welded to each other by a welding process using a current less than 500 amperes.

The hook and the mask frame may also be welded to each other by a tungsten inert gas welding process using a current of about 300~400 amperes.

The spring and the hook may be welded to each other by a tungsten inert gas welding process using a current of about 300–400 amperes.

The color selection apparatus may further include a reinforcing member for preventing the tensioned mask from being thermally deformed during a heat-treatment process including a darkening process, the reinforcing member being fixed on one of upper and lower portions of the elastic member.

The reinforcing member and the elastic member are welded to each other by a tungsten inert gas (TIG) welding process using a current of about 300~400 amperes.

BRIEF DESCRIPTION OF THE DRAWINGS

The accompanying drawings illustrate an embodiment of the invention, and, together with the description, serve to explain the principles of the invention, wherein.

DETAILED DESCRIPTION OF THE INVENTION

Figure 1:
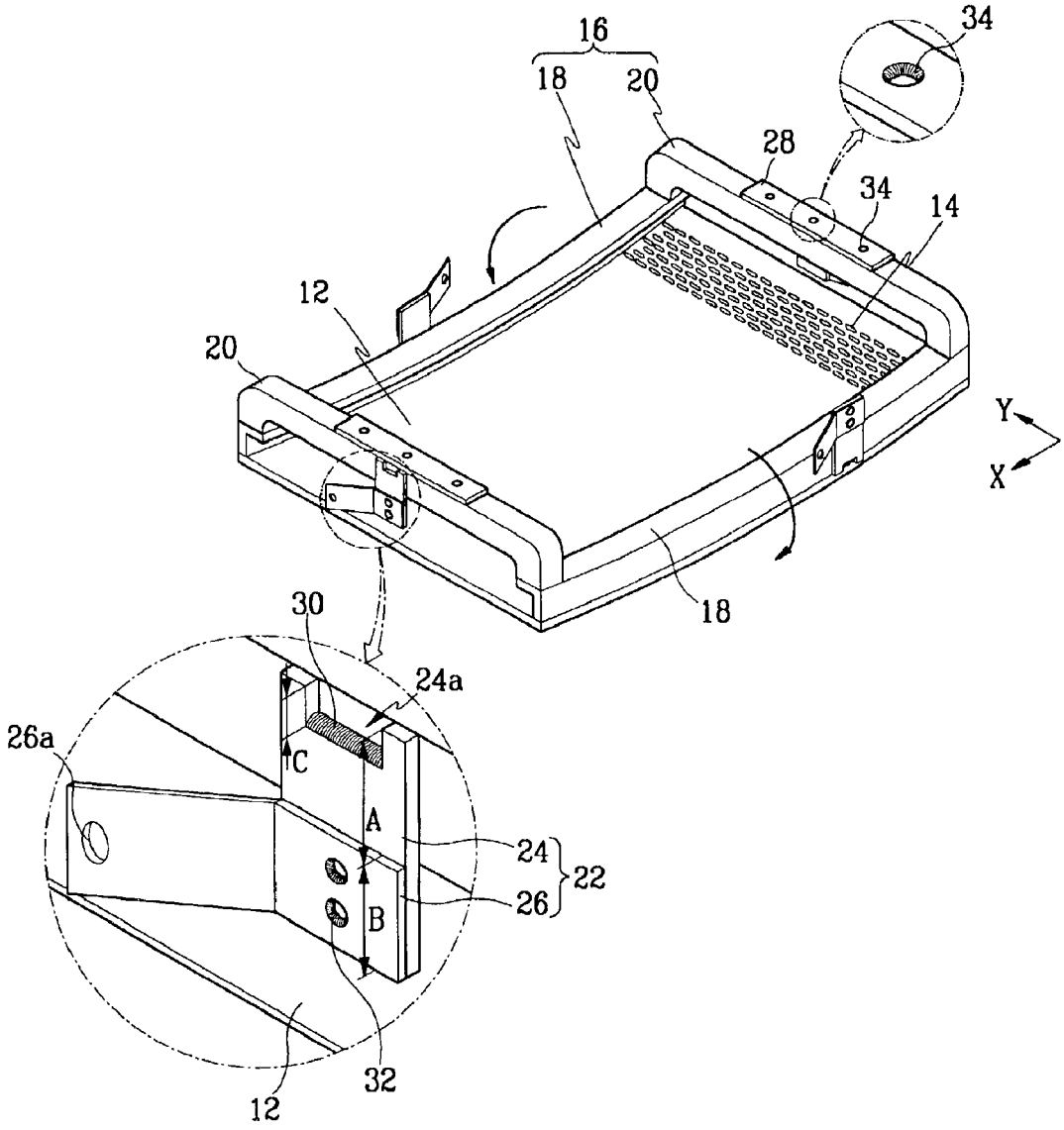
FIG. 1 is a perspective view of a color selection apparatus according to an embodiment of the present invention.

FIG. 1 shows a color selection apparatus according to an embodiment of the present invention is employed.

As shown in the drawing, the inventive color selection apparatus includes tensioned mask 12 functioning as a color selection electrode, mask frame 16 for supporting tensioned mask 12, and a plurality of spring assemblies 22 for fixing mask frame 16 on a panel for a cathode ray tube.

Tensioned mask 12 is formed by drawing AK steel or INVAR steel after a plurality of beam-passing apertures is formed on the steel through a photolithography process. Tensioned mask 12 provided with the plurality of beam-passing apertures 14 is tensioned in a vertical direction (in a direction of a Y-axis in the drawing) and fixed on mask frame 16.

Mask frame 16 includes a pair of supporting members 18 arranged in a direction of an X-axis in parallel and facing the longitudinal sides of tensioned mask 12 and a pair of U-shaped elastic members 20 for maintaining a space between supporting members 18 at a predetermined distance.

Spring assembly 22 for mounting mask frame 16 on an inner surface of the panel is mounted on each sidewall of supporting members 18 and elastic members 20.

Spring assembly 22 includes hook 24 having frame fixing part fixed on mask frame 16 and spring fixing part B and spring 26 having a first end fixed on spring fixing part B of hook 24 and a second end coupled on a stud pin (not shown) buried on an inner surface of the panel through coupling hole 26*a*.

Each of the elastic members 20 is formed of a U-shaped bar, and reinforcing member 28 is welded on elastic member 20 so as to prevent tensioned mask 12 from being thermally deformed during the heat-treatment process including a darkening process Hook 24 is provided at its one end of frame fixing part A with central cut-away part 24*a* defined by cutting a middle portion of the end. In this case, welding portion 30 for welding hook 24 to the mask frame is defined in the vicinity of an end wall of central cut-away part 24*a* in parallel with the end of frame fixing part A. The welding process is preferably performed in a TIG (tungsten inert gas) welding process using a welding current less than 500 amperes.

The spring 26 is welded at its two circular welding portions 32 to spring fixing part B of hook 24. Reinforcing member 28 is welded at its three circular welding portions 34 to a lower part of elastic member 20. At this point, since reinforcing member 28 is fixed on the lower part of elastic member 20, reinforcing member 28 should be selected from a material having a thermal expansion coefficient less than that of elastic member 20 in a high temperature range.

The reinforcing member 28 may be fixed on the upper part of elastic member 20. In this case, reinforcing member 28 should be selected from a material having a thermal expansion coefficient higher than that of elastic member 20 in a high temperature range.

As described above, the TIG welding process for welding spring 26 hook 24, hook 24 and mask frame 16, and reinforcing member 28 and elastic member 20 uses heat generated by an arc electric discharge to melt the members and join them. The current used for the TIG welding process is about 300~400 amperes.

The current of about 300~400 amperes used for the welding process prevents mask frame 16 from being magnetized.

In addition, welding portions 30, 32 and 34 by the TIG welding process makes it possible for a user to inspect the welding quality through his/her naked eyes, thereby avoiding the sampling inspection.

Furthermore, portion C of frame fixing part A, which is not cut-away, from welding portion 30 to the end of frame fixing part A, functions as a shock absorbing member when outer impact is applied to hook 24.

Figure 2:
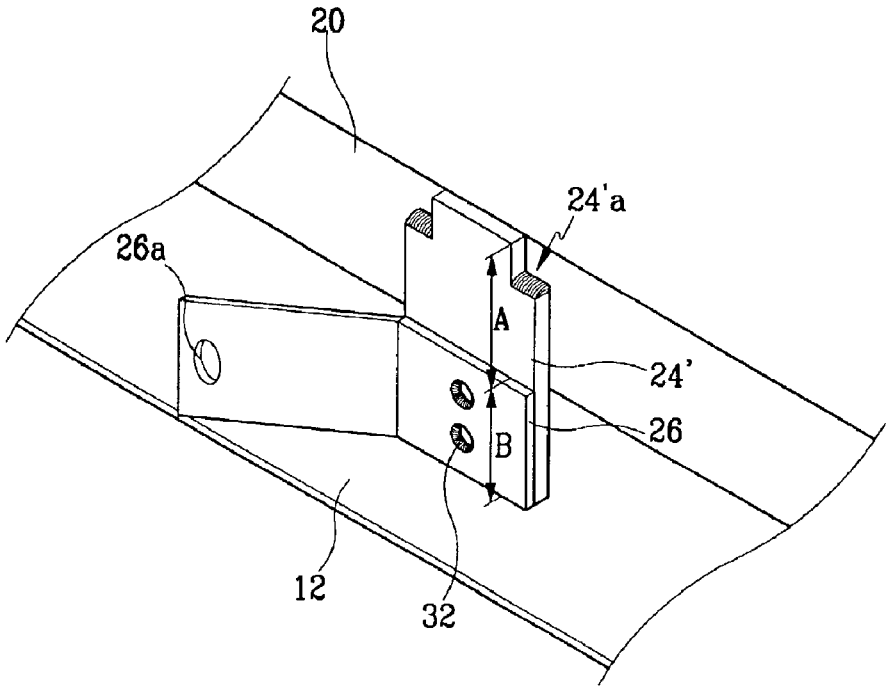
FIG. 2 is a perspective view of a spring assembly according to a modified example of the present invention.

FIG. 2 shows a modified example of the hook.

A hook 24' of this example is provided with cut-away part 24'*a* defined by cutting-way both side ends of frame fixing part A. In this case, a welding portion at which hook 24' welded is to mask frame 16 may be defined in the vicinity of the end walls defined by cut-away part 24'*a* parallel with the end of frame fixing part A.

Figure 3:
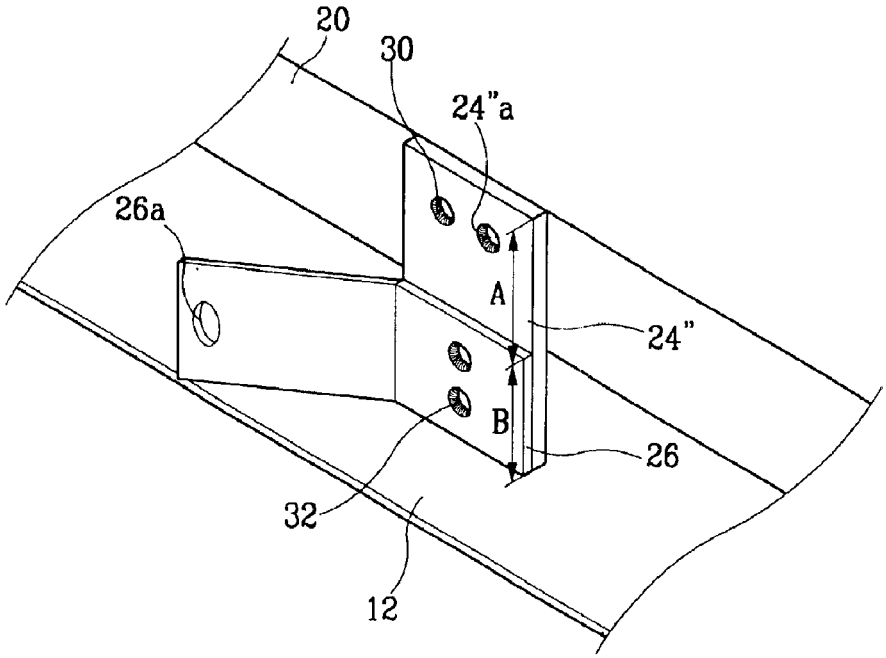
FIG. 3 is a perspective view of a spring assembly according to another modified example of the present invention.
Figure 4:
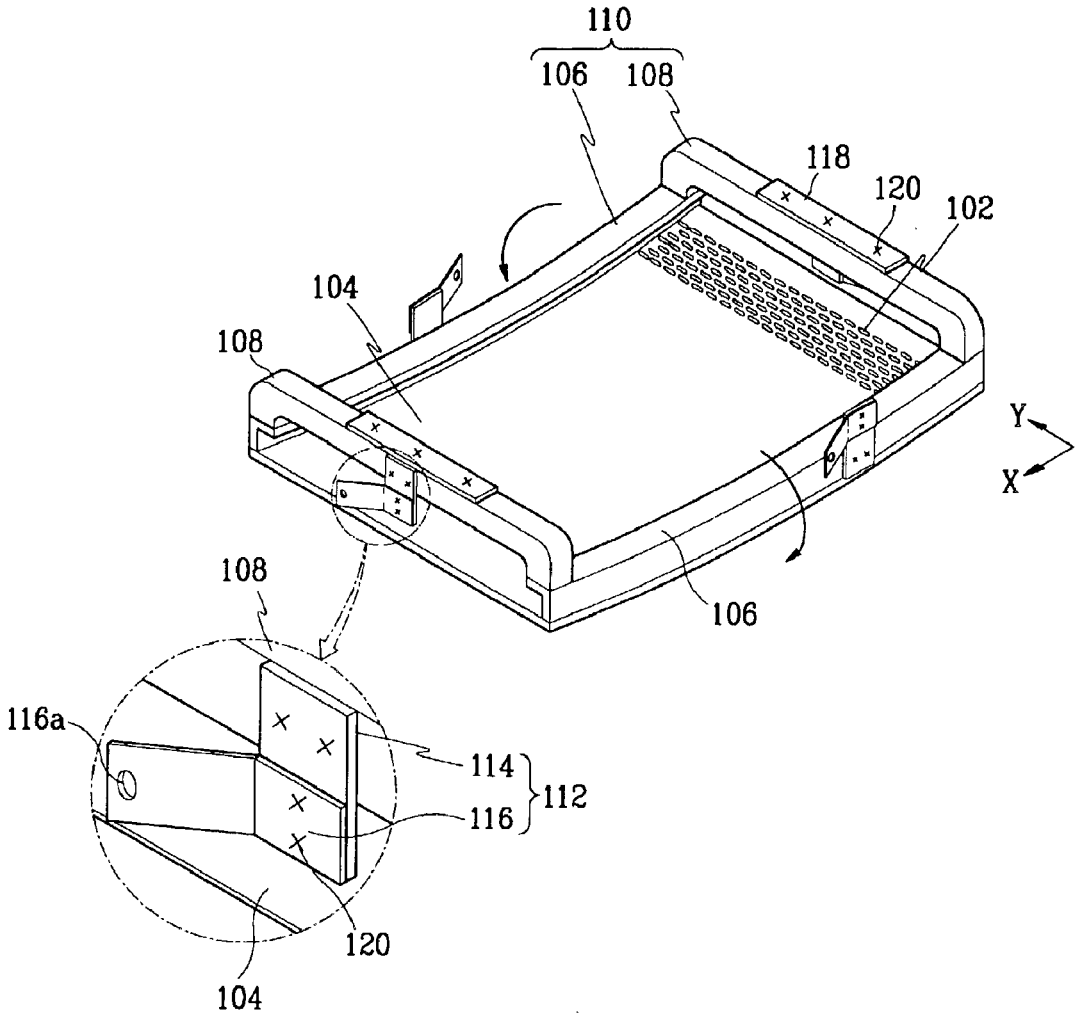
FIG. 4(Prior art)
FIG. 4 is a perspective view of a conventional color selection apparatus for a CRT.

Alternatively, as shown in FIG. 3, cut-way part of hook 24" may be formed of plural circular apertures 24"*a* formed on frame fixing part A. At this point, welding portion 30 is defined in the vicinity of the inner circumferences of apertures 24"*a*.

As described above, by using the TIG welding process using less than 500 amperes, particularly 300~400 amperes, for welding the members such as the hook, the mask frame, and the reinforcing member, the magnetization of the mask frame by the welding current can be prevented, making it possible to avoid the degaussing process. Actually, it is noted that the magnetic flux density of the mask frame of the present invention is less than 10 gausses.

In addition, since the welding portion is designed to be inspected by the naked eye, there is no need for a sampling inspection, thereby reducing the manufacturing costs.

While this invention has been described in connection with certain embodiments, it is to be understood that the invention is not limited to the disclosed embodiments, but, on the contrary, is intended to cover various modifications and equivalent arrangements included within the spirit and scope of the appended claims.

What is claimed is:

1. A color selection apparatus for a cathode ray tube, comprising:

a mask frame having a pair of supporting members disposed in parallel and spaced away from each other and a pair of elastic members disposed between and coupled to the supporting members;

a tensioned mask coupled to the supporting members and provided with a plurality of beam-passing apertures; and a spring assembly including a hook and a spring, the hook having a frame fixing part and a spring fixing part, the spring being fixed to the spring fixing part, the frame fixing part having an external edge cut-away area welded to the mask frame at the external edge cut-away area.

2. The color selection apparatus of claim 1, wherein the external edge cut-away area is a cut-away middle portion of one end of the frame fixing part.

3. The color selection apparatus of claim 2, wherein the external edge cut-away area is formed in the vicinity of and in parallel with the one end of the frame fixing part.

4. The color selection apparatus of claim 1, wherein the external edge cut-away area are cut-away of both corners of one end of the frame fixing part.

5. The color selection apparatus of claim 4, wherein the external edge cut-away area is in parallel with tile one end of the frame fixing part.

6. The color selection apparatus of claim 1, wherein the hook and the mask frame are welded to each other by a welding process using a current less than 500 amperes.

7. The color selection apparatus of claim 6, wherein the hook and the mask frame are welded to each other by a tungsten inert gas welding process using a current of about 300–400 amperes.

8. The color selection apparatus of claim 1, wherein the spring and the hook are welded to each other by a tungsten inert gas welding process using a current of about 300 –400 amperes.

9. The color selection apparatus of claim 1 further comprising a reinforcing member being fixed on one of upper and lower portions of the elastic member for preventing the tensioned mask from being thermally deformed during a heat-treatment process including a darkening process.

10. The color selection apparatus of claim 9, wherein the reinforcing member and the elastic member are welded to each other by a tungsten inert gas welding process using a current of about 300–400 amperes.

11. A color selection apparatus for a cathode ray tube, comprising:

a mask frame having a pair of supporting members disposed in parallel and spaced away from each other and a pair of elastic members disposed between and coupled to the supporting member;

a tensioned mask coupled to the supporting members and provided with a plurality of beam-passing apertures; and a spring assembly including a hook and a spring, the hook having a frame fixing part and a spring fixing part, the spring being fixed to the spring fixing part, the frame fixing part having a cut-away portion welding the hook to the mask frame at the cut-away portion.

wherein the cut-away welding portion are cut-aways of both corners of one end of the frame fixing part.

12. The color selection apparatus of claim 11, wherein the cut-away portion is in parallel with the one end of the frame fixing part.

* * * * *